US005711103A

United States Patent [19]

Keng

[11] Patent Number: 5,711,103

[45] Date of Patent: Jan. 27, 1998

[54] BIPOD MOUNTING DEVICE

[76] Inventor: Da Keng, 875 Wharton Dr., SW., Atlanta, Ga. 30336

[21] Appl. No.: 542,822

[22] Filed: Oct. 13, 1995

[51] Int. Cl.[6] ..... F41A 23/10

[52] U.S. Cl. ..... 42/94; 89/37.04

[58] Field of Search ..... 42/94; 248/187.1, 248/177.1; 89/40.06, 37.04

[56] References Cited

U.S. PATENT DOCUMENTS

| | | | |
|---|---|---|---|
| 1,594,365 | 8/1926 | Haubroe | 89/37.04 |
| 1,919,554 | 7/1933 | Howell | 248/187.1 |
| 1,977,629 | 10/1934 | Heavey | 89/40.06 |
| 2,081,929 | 6/1937 | Heavy | 89/40.06 |
| 3,006,052 | 10/1961 | Stickney et al. | 248/263 |
| 3,029,053 | 4/1962 | Loehnis | 248/187 |
| 4,085,915 | 4/1978 | Song et al. | 248/187 |
| 4,570,877 | 2/1986 | Banister | 248/187 |
| 4,903,425 | 2/1990 | Harris | 42/94 |
| 5,194,678 | 3/1993 | Kramer | 42/94 |
| 5,345,706 | 9/1994 | Brown | 42/94 |

*Primary Examiner*—Michael J. Carone
*Assistant Examiner*—Christopher K. Montgomery
*Attorney, Agent, or Firm*—Isaf, Vaughan & Kerr

[57] ABSTRACT

A bipod mounting assembly for attaching a bipod to the forearm stock portion of a firearm, which includes a mounting yoke adapted to quickly and easily attach to the swivel stud connector mounted to the forearm stock portion of the firearm. The mounting yoke is adapted to receive a mounting block thereover, with the mounting block being attached to the mounting yoke to thus attach the mounting block to the forearm stock portion of the fire arm. A bipod mounting frame that includes a pair of extensible telescoping legs is releasably attachable to the mounting block by a quick-release locking catch to enable the quick attachment/detachment of the legs of the bipod from the mounting block, and thus the firearm.

9 Claims, 3 Drawing Sheets

BIPOD MOUNTING DEVICE

FIELD OF THE INVENTION

This present invention generally relates to firearm support devices. In particular, the present invention relates to a mounting device for attaching a bipod support to the forearm stock of a firearm that attaches to the swivel stud of the firearm to enable the quick and easy attachment and detachment of the bipod to the firearm without modification of the forearm stock of the firearm.

BACKGROUND OF THE INVENTION

When shooting firearms, it is important that the firearm be maintained in a steady, stable position to insure accuracy of aim. However, most shooters are not able to consistently hold a firearm in a set position without wavering, especially after the onset of fatigue and strain being placed on the shooter due to the size and weight of the firearm. Accordingly, peripheral support devices have been used in conjunction with firearms since the early creation of firearms as a means of stabilizing a firearm to reduce vibration, wavering, etc., and to improve accuracy thereof.

In the past, shooters have used everything from large stationary objects such as rocks and tree branches to forked sticks, shooting slings, bipods and tripods. Early bipod and tripod supports typically were somewhat crude strands that generally were bulky, inconvenient and difficult to use and typically were not easily adjustable. In more recent times, bipod supports have been developed that are compact and relatively lightweight and are mountable to the forearm stock of a firearm, such as a rifle, so as to make the bipods portable with the firearm. Most conventional bipod supports include a pair of legs that can be pivoted from an up position adjacent the firearm stock, to a down position engaging a support surface, with the legs also being extensible to adjust the height of the support.

A problem with conventional bipods has been the ability of the bipod to mount to most firearms without requiring the use of special mounting tools and the machining or modification of the firearm stock to accommodate the bipod. Additionally, most bipods are not designed for quick and easy attachment and release of the bipod from the firearm stock. For example, U.S. Pat. No. 5,194,678 discloses a bipod assembly that includes legs that are pivotable independently of one another for ease of adjustment, but which is not easily attached/detached from the firearm. Other types of conventional bipods offer varying types of mountings that can be fitted to various types of rifles without requiring modification or machining of the rifle stock. For example, Harris Engineering, Inc. manufactures a series of bipod mounts for use with a variety of different firearms. However, these bipod mounts do not provide for the quick-release of the bipods from the firearm.

Further, one of the most popular bipods on the market has been the Parker-Hale bipod assembly. This bipod includes a pair of telescoping legs attached to a mounting frame, and a mounting block for mounting the bipod to the firearm. The mounting block of the Parker-Hale bipod is releasably attached to the mounting frame of the bipod to enable quick attachment/release of the legs of the bipod from the firearm. The problem with the Parker-Hale bipod is that to mount the bipod to a firearm, the forearm stock of the firearm generally must be modified to mount a track or slide therein, along which the mounting block is received to mount the bipod to the firearm. Such modifications generally are expensive and often must be done by specialty gunsmiths and can mar the finish of the firearm.

Accordingly, it can be seen that a need exists for a bipod mounting device for attaching a bipod to a firearm without requiring extensive modification and machining of the forearm stock of the firearm and which enables the quick attaching and detaching of the bipod from the firearm.

SUMMARY OF THE INVENTION

Briefly described, the present invention comprises a bipod mounting device for mounting a bipod support to the forearm stock of a firearm such as a riffle. In particular, the present invention is directed to use for mounting a Parker-Hale type firearm bipod of the type including a contoured mounting block adapted to attach to the forearm stock of the firearm. The mounting block is releasably attachable to a bipod mounting frame by means of a quick release connector such as a bayonet lock or similar locking means. The bipod mounting frame includes a pair of extensible/retractable legs, each having a pair of telescoping sections to enable the height of the bipod to be adjustable as desired.

The bipod mounting device of the present invention generally comprises a substantially U-shaped mounting yoke that is adapted to be received within a cubically shaped recess or aperture formed on the upper side surface of the mounting block of the bipod. The yoke includes a substantially square-shaped base plate of a size slightly less than the size of the recess formed in the mounting block, and includes a pair of parallel sidewalls extending upwardly therefrom. The base plate is a substantially flat plate having a threaded opening or bore formed approximately through the center thereof. The sidewalls are spaced, substantially square-shaped walls and are adapted to fit about the sides of a swivel stud mounted to the forearm stock of the firearm, with the head of the swivel stud being received between the side walls. The side walls include aligned fastener openings through which a fastener is received and attaches to the side walls, with the shank of the fastener extending through the head of the swivel stud to attach the yoke to the swivel stud.

Once the yoke has been attached to the swivel stud of the firearm, the mounting block of the bipod is placed on the yoke, with the yoke received within the recess formed in the upper surface of the mounting block. A securing bolt assembly is extended through the bottom surface of the mounting block. The securing bolt assembly engages the threaded opening in the base plate of the yoke to attach the mounting block to the yoke and thus to the forearm stock of the firearm. The resulting attachment of the mounting block to the forearm stock provides a quick and easy attachment of the mounting block to the firearm and enables the mounting block to mount securely to the forearm stock of the firearm in a stable, secure position. This prevents the mounting block, and thus the bipod, from shifting or wobbling during use. With the mounting block securely mounted to the forearm stock of the firearm, the bipod frame is placed in locking engagement with the mounting block to mount the bipod frame to the firearm. Additionally, a detachable sling loop can be provided with the securing bolt assembly for attachment of a rifle sling to the stock of the firearm.

Various objects, features and advantages of the present invention will become apparent to one skilled in the art upon a review of the following specification, when taken in conjunction with the accompanying drawings.

DETAILED DESCRIPTION OF THE PREFERRED EMBODIMENT

Figure 1:
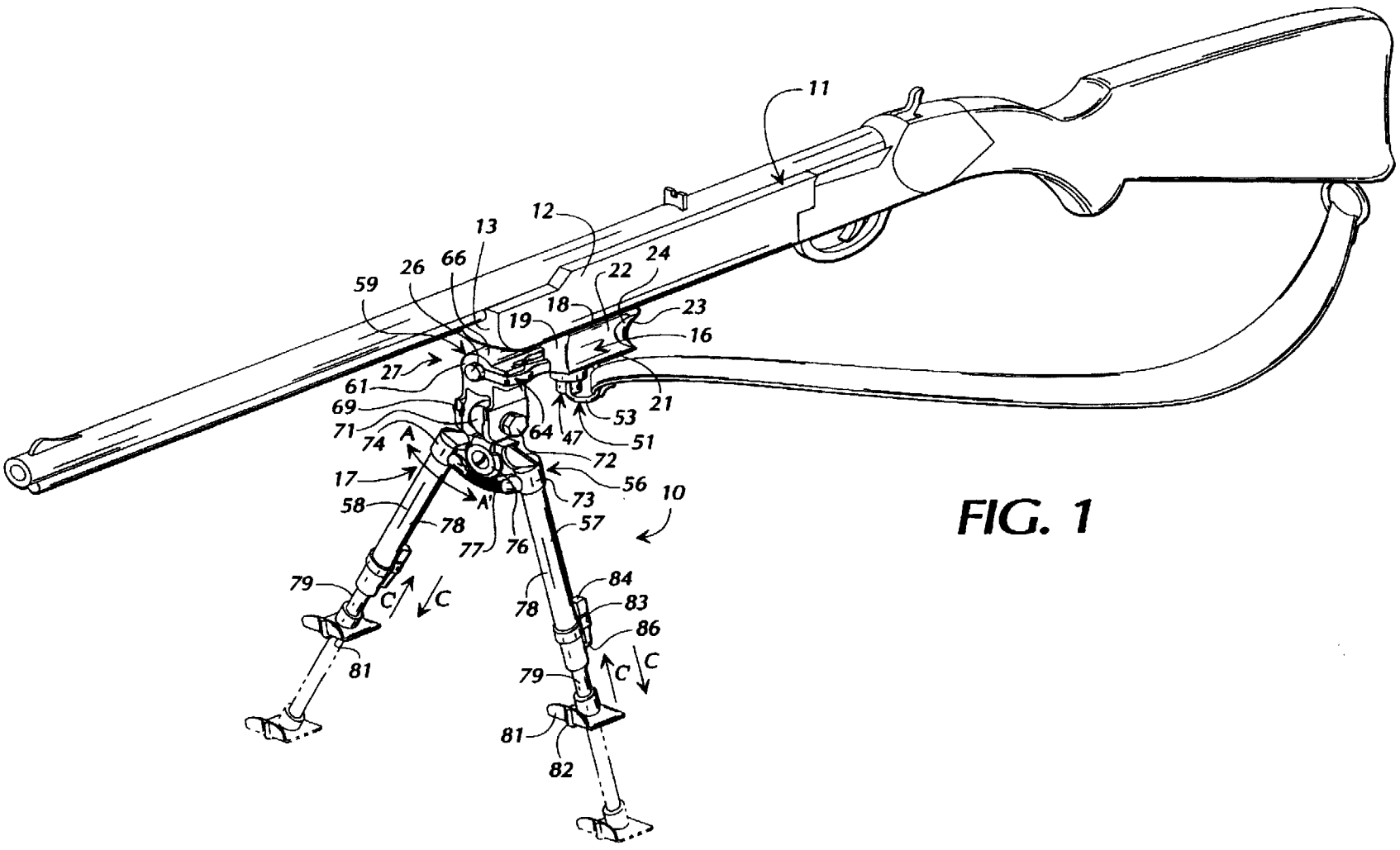
FIG. 1 is a perspective illustration of a firearm with a bipod mounted thereto.

Referring now in greater detail to the drawings in which like numerals indicate like parts throughout the several views, the present invention comprises a bipod mounting assembly for mounting a bipod 10, to a firearm 11 such as a rifle, as shown in FIG. 1. The bipod 10 generally is mounted to the forearm stock portion 12 of the firearm 11 adjacent the front end 13 of the forearm stock. By mounting the bipod to the formed stock portion of the firearm, a shooter is provided with a stable platform for use in aiming and shooting the firearm.

Figure 2:
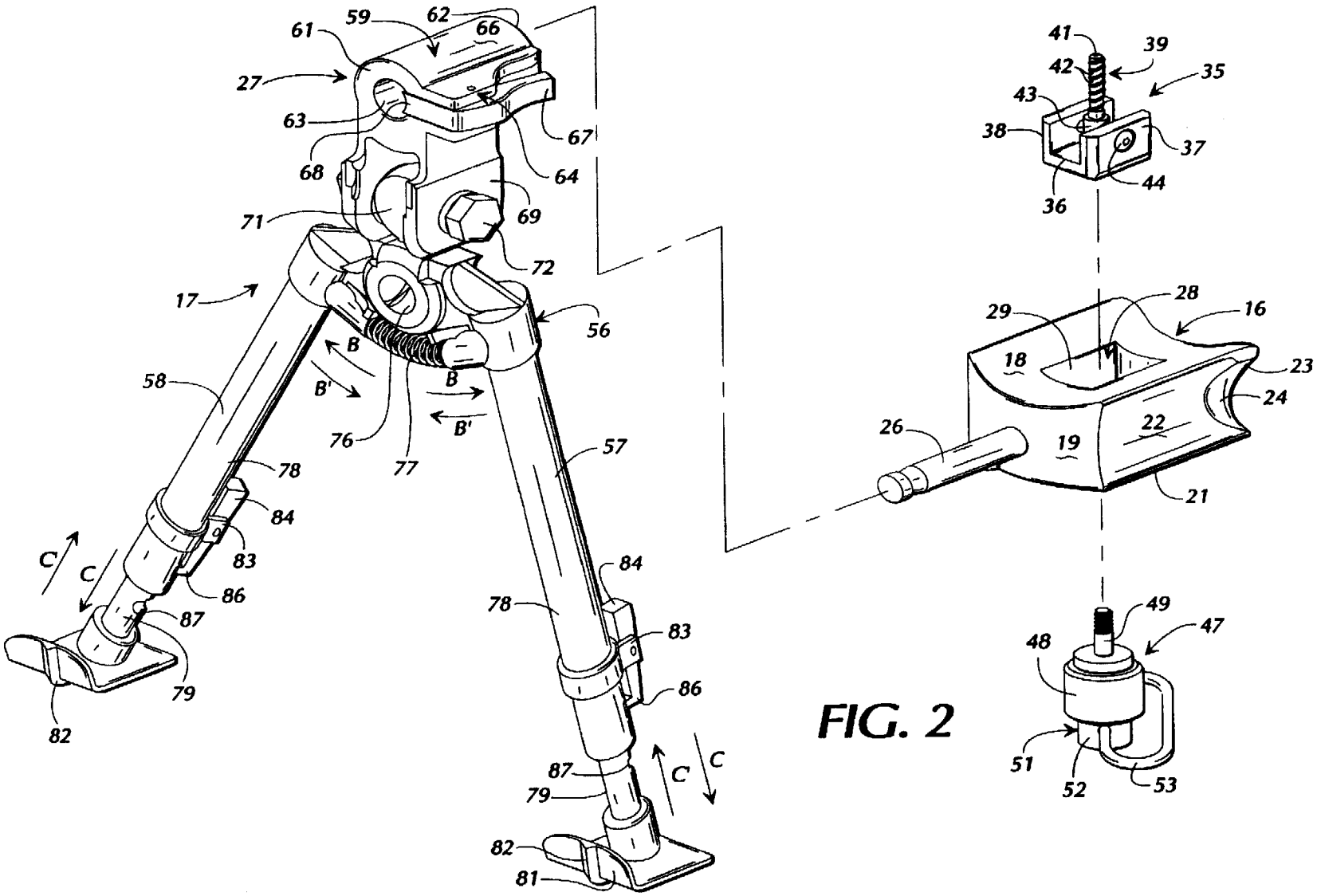
FIG. 2 is an exploded perspective view of the bipod shown in FIG. 1, and illustrating the use of the bipod mounting device of the present invention therewith.
Figure 3:
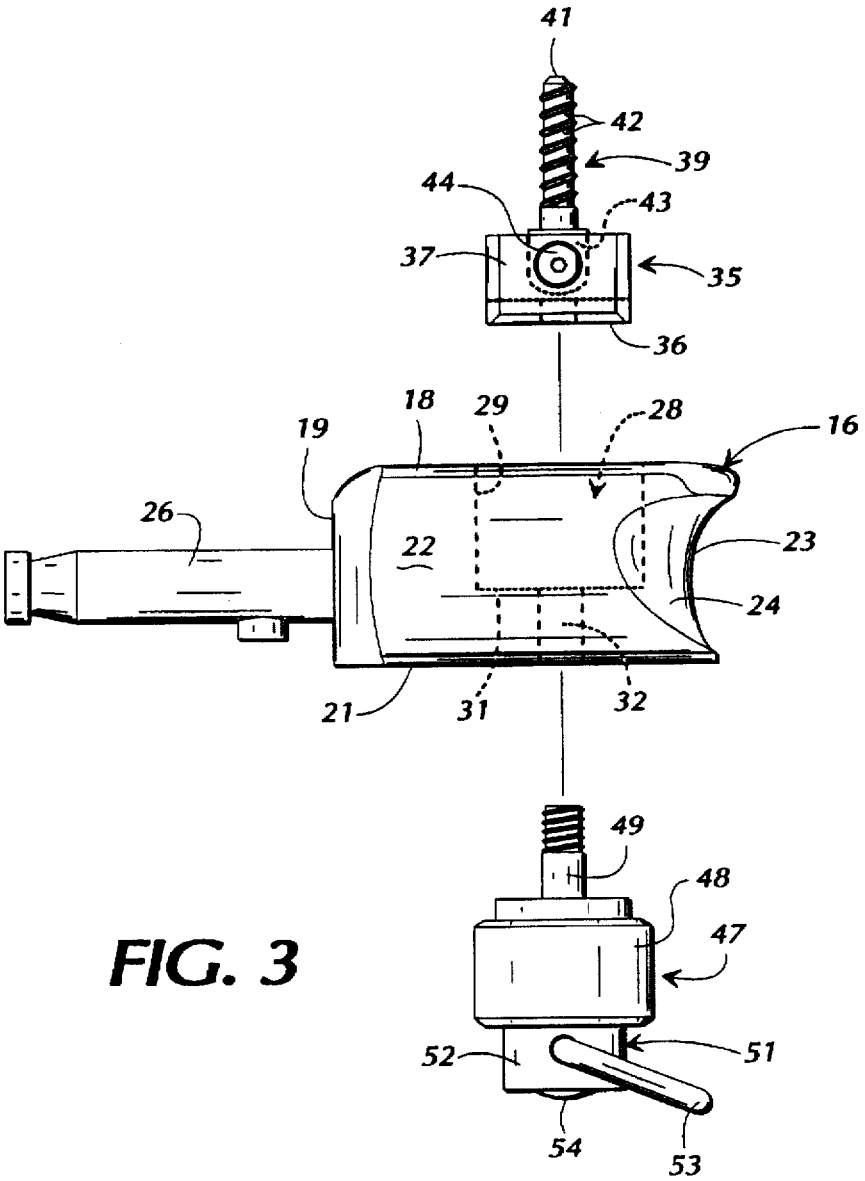
FIG. 3 is a side elevational view illustrating the attachment of the bipod mounting device of the present invention with a bipod mounting block.

As FIGS. 1 and 2 illustrate, the bipod 10 generally is a Parker-Hale type bipod that includes a contoured mounting block 16 and a bipod mounting frame 17 to which the mounting block 16 is releasably attachable. The mounting block 16 generally is a substantially rectangularly-shaped block typically formed from a plastic or similar, durable, weather resistant materials. The mounting block 16 includes a curved, concave upper surface 18, front surface 19, substantially flat bottom surface 21, concave side surfaces 22 and a curved, contoured rear surface 23. As indicated in FIGS. 2 and 3, the rear surface 23 of the mounting block 16 curves inwardly and includes shaved wing portions 24 of either side thereof, so as to give the rear surface 23 of the mounting block a contour and shape adapted to fit to the web of the hand of a shooter when a shooter holds the firearm along its forearm stock portion. The mounting block thus is configured so as to enable the shooter to easily and securely grip the forearm stock portion of the firearm when the mounting block is attached thereto, without interfering with the gripping of the firearm by the shooter. The mounting block further includes a mounting post 26 that is mounted to and extends forwardly from the front surface 19 of the mounting block. The mounting post generally is a cylindrically-shaped rod adapted to engage and lock into a locking means 27 of the bipod mounting frame 17.

As shown in FIGS. 2 and 3, an open ended recess or cavity 28 is formed in the mounting upper surface 18 of the mounting block 16. The cavity 28 generally is a substantially rectangularly or cubically shaped cavity having a series of substantially flat upstanding side walls 29 and a substantially flat bottom 31 (FIG. 3). A bore or passage 32 is formed through the body of the mounting block 16, and extends from the bottom 31 of the cavity 28 through the bottom surface 21 of the mounting block.

Figure 4:
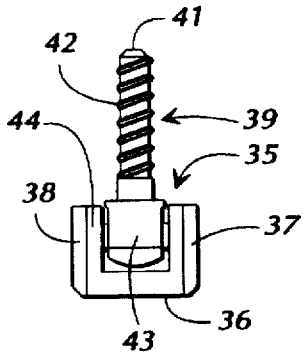
FIG. 4 is an end view illustrating the attachment of the yoke of the bipod mounting device of the present invention about the head of a swivel stud of a firearm.

A mounting yoke 35 (FIGS. 3 and 4) is adapted to be received within the side walls 29 (FIG. 3) of the cavity 28 of the mounting block 16 and functions as a means for attaching the mounting block to the forearm stock portion 12 (FIG. 1) of a firearm 11. As illustrated in FIGS. 2, 3 and 4, the mounting yoke 35 generally is a substantially U-shaped block that is formed from a metal such as steel or similar durable, high-strength material. The mounting yoke includes a substantially rectangularly shaped base 36, and a pair of spaced, parallel side walls 37 and 38 projecting upwardly from the base 36 so as to provide the mounting yoke with a substantially U-shaped cross-section. The side walls 37 and 38 are spaced apart at a distance sufficient to enable a swivel mounting stud 39 for the firearm to be received and mounted therebetween. As FIG. 4 illustrates, the swivel stud comprises a threaded fastener having a shank 41 having a helical thread 42 wound thereabout and formed thereabout, and a rounded head portion 43. A fastener such as a bolt 44 is received through the side walls 37 and 38 of the mounting yoke 35 and through the head 43 of the swivel stud 39 to attach the mounting yoke to the swivel stud.

A recess 46 (FIG. 3) is formed in side wall 37 of the mounting yoke to enable the head of the fastener 44 to be countersunk into the side wall of the mounting yoke so as to lie flush with the side wall of the mounting yoke. Additionally, as shown in FIGS. 2 and 3, a detachable securing bolt assembly 47 is mounted to the mounting block 16 through the bottom surface 21 thereof. The securing bolt assembly 47 generally is substantially cylindrically shaped and is formed from a metal such as steel, and includes a body portion 48, a connecting stud 49 mounted to and extending upwardly from the upper end of the body 48 and a rifle sling connector loop 51 detachably mounted to the lower end of the body. The connector stud 49 is received throughout the bore 32 formed through the bottom surface 21 of the mounting block 16 and, as illustrated in FIGS. 2 and 3, is adapted to engage and attached to the base 36 of the mounting yoke 35. As a result, the securing bolt assembly is attached to the mounting yoke and thus to the swivel stud 39 of the firearm to secure the mounting block 16 to the forearm stock 12 (FIG. 1) of the firearm 11. The detachable connector loop 51 typically is formed as a quick release connector having a connector body 52 through which a sling loop 53 is attached and further includes a release button 54 (FIG. 3) which, when depressed, releases the connector loop 51 from the body 48 of the securing bolt assembly 47. As shown in FIG. 1, a rifle sling can be looped through the connector loop or clip thereto to attach the rifle sling to the connector loop as desired.

As shown in FIG. 2, the mounting post 26 of the mounting block 16 is adapted to be received in locking engagement with the locking means 27 of the bipod mounting frame 17. To attach the bipod mounting frame to the mounting block and thus to the forearm stock of the firearm. As shown in FIGS. 1 and 2, the bipod mounting frame generally includes the locking means 27, pivotally mounted to leg support frame 56 from which a pair of extensible legs 57 and 58 depend. The locking means 27 includes a housing 59 having a front end 61 and a rear end 62 and a substantially cylindrically shaped bore 63 formed internally through the housing between the front and rear ends 61 and 62. The bore receives the mounting post 26 of the mounting block 16 therethrough as illustrated in FIG. 2. A locking catch or finger 64 is pivotally mounted to the side surface 66 of the housing 59, positioned adjacent the bore 63. The locking catch includes a distal or free end 67 positioned adjacent the rear end 62 of the housing, biased outwardly therefrom, and a substantially C- or hooked-shaped proximal end 68 positioned adjacent the open end of the bore 63 at the front end 61 of the housing. The engaging end 68 is biased against the front end of the mounting post 26 with the mounting post received through the bore 63 so as to lock the mounting post within the bore. The locking means further includes a pair of downwardly extending, spaced struts 69 that project downwardly from the housing and receive a ball connector 71 therebetween and are pivotally attached to the bolt connector by fastener 72 to pivotally mount the leg support frame 56 to the housing 59.

The leg support frame additionally includes a pair of pivoting connector sleeves 73 and 74 so that are pivotally connected to the bolt connector 71 by a pivot pin such as a fastener 76. The sleeves 73 and 74 further are connected to one another by a compression spring 77 that tends to bias or urge the connector sleeves apart in the direction of arrows C. The upper ends of the connector sleeves are configured so as to engage and fit between the struts 69 of the locking means when the leg support frame is folded with the legs in their compress positioned, urged together in the direction of arrows C', and with the leg support frame pivoted to its raised, non-engaging position shown in the direction of arrow A to lock the legs in their close, together position when not in use. As the legs are pivoted rearwardly in the direction of arrow A', the connector sleeves are released from engagement with the struts of the locking means and are urged outwardly to spread apart upwardly position in the direction of arrows B by the compression spring 77 to the position shown in FIGS. 1 and 2.

As illustrated in FIGS. 1 and 2, the legs 57 and 58, are substantially cylindrically shaped and generally are formed from a metal such as steel. Each of the legs includes a pair of telescoping sections 78 and 79, with section 79 being slideably received within section 78 to make the legs extensible and retractable in the direction of arrows C and C'. Feet 81 are mounted to the lower ends of sections 79 of each leg, generally formed from a metal such as steel, and also can be formed with ridges 82 or other ground engaging means to prevent slipping and provide the feet with a non-skid surface. Locking tabs 83 are attached to the telescoping sections 78 of the legs 57 and 58 adjacent the lower ends thereof. The locking tabs are pivotally mounted to the telescoping sections 78 and include an upper, free end 84 and a lower, hooked shaped engaging end 86. The hooked shaped engaging ends 86 of the locking tabs 83 are received through openings (not shown) formed in the telescoping sections 78 of the legs and engage locking recesses 87 formed in the lower telescoping sections 79 of the legs to lock the telescoping sections 79 at a set or desired height to enable adjustment of the height of the legs as desired.

In use of the bipod mounting assembly of the present invention, the mounting yoke 35 is attached to the swivel stud 39 mounted in the stock portion 12 (FIG. 1) of a firearm 11 such as a rifle. The mounting yoke is attached to the swivel stud by positioning the head of the swivel stud between the side walls 37 and 38 of the yoke and inserting a fastener 44 therethrough. The size and configuration of the mounting yoke enables its attachment to the forearm stock portion of the firearm without interfering with the use and gripping of the firearm by a shooter. A mounting block 16 thereafter can be attached to the mounting yoke by simply placing the mounting block over the mounting yoke with the mounting yoke being received within the open ended cavity 28 formed through the upper surface of the mounting block. The mounting block is secured to the mounting yoke by the insertion of the connector stud 49 of a securing bolt assembly 47 through the bore 32 formed through the bottom of the mounting block and the engagement and attachment of the rifle sling connector to the base of the mounting block as indicated in FIGS. 2 and 3.

Thereafter, a bipod mounting frame 17 is received and mounted to the mounting block by the insertion of the mounting post 26 of the mounting block through the bore 63 of the housing 59 of the locking means 27 of the bipod mounting frame. The locking catch 64 enables the quick attachment/detachment of the bipod mounting frame to the mounting block as needed. Thereafter, with the bipod mounting frame connected to the forearm stock portion 12 (FIG. 1) of the firearm, the legs 57 and 58 thereof can be folded in the direction of arrow A into a raised non-operative position when not in use, and can quickly be lowered in the direction of arrow A' to a operative, ground engaging position when needed.

The mounting yoke of the present invention also enables the contoured mounting block to be utilized with a variety of different types and styles of firearms, and enables the quick and easy attachment and detachment of the mounting block, and thus the bipod itself, to such firearms without requiring additional machinery and reconfigurations of the firearm as the present invention utilizes the swivel stud commonly found with most firearms for the quick and easy attachment of the bipod mounting block and thus the bipod thereto. Additionally, when the bipod and its mounting block have been removed from the firearm, the size and configuration of the mounting yoke does not interfere with the ability to grip the forearm stock portion of the firearm and thus does not interfere with the stability and aim of the shooter.

It will be understood that while the foregoing relates to a preferred embodiment of the present invention, various modifications, additions and changes may be made thereto without departing from the spirit and scope of the invention as set forth in the following claims.

Further, it will be understood by those skilled in the art that while the present invention has been disclosed for use primarily with the parker-Hale bipod assembly, the present invention also can be used for mounting the types of pipods having a biod leg frame that is releasibly mountable to a mounting block therefor to a firearm

I claim:

1. A bipod support for a firearm, comprising:

a mounting block adapted to be mountable to a stock portion of the firearm and having a substantially square shaped recess formed therein;

a pair of legs connected to said mounting block and extending downwardly therefrom for supporting the firearm in a stable orientation; and means for mounting said mounting block to the stock portion of the firearm, said means comprises a substantially U-shaped yoke adapted to fit within said recess formed in said mounting block and having a base plate, a pair of parallel side walls depending from said base plate and adapted to mount to a swivel stud attached to the stock portion of the firearm with the swivel stud received between said side walls, and a bore formed in said base plate in which a fastener can be received to attach said mounting block to said yoke.

2. The bipod support of claim 1 and further including a leg frame having a quick release connector for receiving and mounting said mounting block thereto and pivotable leg brackets which said legs are attached so as to be pivotable toward and away from one another.

3. The bipod support of claim 1 and further including a securing bolt received through said mounting block and which engages said means for mounting to secure said mounting block to said means for mounting.

4. The bipod support of claim 1 and wherein said mounting block has a contoured portion along a rearward edge thereof for ease of gripping the firearm.

5. The bipod support of claim 2 and wherein said legs each include a first leg portion mounted to one of said leg brackets, and a second leg portion that telescopes into and out of said first leg to extend and retract said legs.

6. A mounting block assembly for being secured to a swivel stud depending from the stock of a firearm, the swivel stud having an exposed eye extending therethrough, said mounting block assembly comprising:

a mounting block having an aperture formed in an upper surface thereof;

a substantially rigid mounting member having a pair of parallel side walls that define a central channel sized to receive the swivel stud, a removable fastener adapted to be extended between said parallel side walls of said mounting member and through the eye of the swivel stud to fasten said mounting member to the swivel stud, said mounting member adapted to be received within said aperture formed within said upper surface of said mounting block and to receive a securing means extending through said mounting block for securing said mounting member within said aperture of said mounting block, said securing means selectively drawing said mounting member downwardly into said aperture for securing said mounting block firmly against the stock of the firearm.

7. The device of claim 6 and wherein said mounting member has a substantially U-shaped cross-section.

8. The device of claim 6 and wherein said securing means comprises a threaded connector bolt having a detachable sling loop.

9. The device of claim 6 and wherein said mounting member comprises a substantially U-shaped yoke having a base from which said side walls upwardly extend, said base having a connector opening formed therein for receiving said securing means.

* * * * *